United States Patent [19]

Hruda

[11] 4,088,859

[45] May 9, 1978

[54] NORMAL OPEN LOW VOLTAGE VACUUM SHORTING SWITCH

[75] Inventor: Robert M. Hruda, Horseheads, N.Y.

[73] Assignee: Westinghouse Electric Corp., Pittsburgh, Pa.

[21] Appl. No.: 771,143

[22] Filed: Feb. 23, 1977

[51] Int. Cl.[2] ..... H01H 33/66

[52] U.S. Cl. ..... 200/144 B; 200/83 D

[58] Field of Search ..... 200/83 D, 144 B

[56] References Cited

U.S. PATENT DOCUMENTS

| | | | |
|---|---|---|---|
| 2,724,030 | 11/1955 | Hilgert | 337/329 |
| 2,943,167 | 6/1960 | Hughes | 200/83 D |
| 3,087,034 | 4/1963 | Beers et al. | 200/144 B |
| 3,131,276 | 4/1964 | Watson | 200/144 B |
| 3,182,156 | 5/1965 | Lee et al. | 200/144 B |
| 3,246,979 | 4/1966 | Lafferty et al. | 200/144 B |
| 3,950,628 | 4/1976 | Hruda | 200/302 |

FOREIGN PATENT DOCUMENTS

| | | | |
|---|---|---|---|
| 351,809 | 4/1922 | Germany | 200/144 B |
| 563,140 | 11/1932 | Germany | 200/144 B |
| 1,218,583 | 6/1966 | Germany | 200/144 B |
| 2,260,587 | 6/1974 | Germany | 200/144 B |
| 571,959 | 1/1958 | Italy | 200/144 B |
| 1,093,231 | 11/1967 | United Kingdom | 200/144 B |
| 1,204,458 | 9/1970 | United Kingdom | 200/144 B |

*Primary Examiner*—Robert S. Macon
*Attorney, Agent, or Firm*—W. G. Sutcliff

[57] ABSTRACT

A low voltage cell shorting vacuum switch is biased in the normally open position as well as being protected from the cell corrosive atmosphere by an electrically insulating, resilient elastomeric annular member.

5 Claims, 1 Drawing Figure

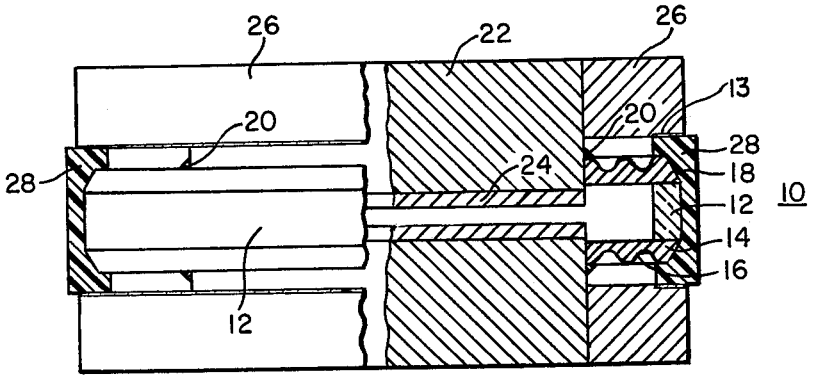
26
22
26
13
20
20
28
28
24
18
10
12
14
16
12

NORMAL OPEN LOW VOLTAGE VACUUM SHORTING SWITCH

BACKGROUND OF THE INVENTION

The present invention relates to vacuum switches which are designed for use with low direct current voltage electrolytic chemical cells. In such electrolytic chemical cells a very high current level of thousands of amperes are passed through a conductive solution to produce desired chemicals such as chlorine. Many such cells are connected in series and a reliable shunting switch is needed to facilitate bypassing of one or more such cells from the other operative cells for routine maintenance.

The vacuum switch is particularly advantageous for use in the vicinity of such chemical processing equipment with the attendant corrosive atmosphere that is typically present. The electrical contacts of the switch are disposed within the evacuated chamber of the switch and are thus protective from corrosion ensuring their reliable long operating lifetime. An example of a bellows type vacuum switch for such use is seen in U.S. Pat. No. 3,950,628 issued Apr. 13, 1976 and owned by the assignee of the present invention. An improved low voltage vacuum switch designed for such applications is described in copending application Ser. No. 650,322 filed Jan. 19, 1976. In the design described in the copending application, the switch has a very compact profile with corrugated metal diaphram members which permit contact movement while providing a hermetically sealed evacuated device. This copending application also describes the desirability of providing a protective elastomeric insulative member fitted about the switch to protect the thin corrugated metal diaphram walls from the corrosive environment.

Another prior art vacuum switch device is described in West German Pat. 1,218,583, in which one of the contacts is mounted on a support rod extending from a resilient bellows seal. A silicone resin layer is taught on the exterior surface of the flexible or resilient bellows end piece as a protective covering.

In certain electrolytic cell installations, safety requirements dictate that the vacuum switch be fail-safe in the normally open position. Since such vacuum switches are highly evacuated, the atmospheric force acting on the device tends to force the movable contacts together to the closed position. Biasing springs have been used with vacuum switches for biasing them normally open, but such springs are themselves questionable due to the exposure to the corrosive atmosphere associated with the chemical cell.

SUMMARY OF THE INVENTION

A vacuum switch structure is detailed which includes an electrically insulating, resilient elastomeric annular member disposed between the opposed spaced apart external parallel plate connection members. The thickness and resilience of the elastomeric annular member is such that the switch contacts are normally spaced apart in a fail-safe open circuit position. A compressive force must be exerted on the parallel plate connection member to compress the resilient, elastomeric annular member and bring the contacts together within the vacuum chamber to close the switch.

BRIEF DESCRIPTION OF THE DRAWING

The sole FIGURE is a side elevation view partly in section which illustrates the vacuum switch structure of the present invention.

DESCRIPTION OF THE PREFERRED EMBODIMENT

The invention can be best understood by reference to the embodiment seen in the sole FIGURE. The low voltage DC vacuum switch 10 comprises an insulative ceramic body ring 12, which serves as a portion of the vacuum chamber defining wall and serves to electrical isolate opposed ends of the switch. The opposed end surfaces 13 of the ceramic body ring 12 are metallized, and a pair of thin, flexible, corrugated annular members 14 are sealed to respective metallized end surface 13. The outer perimeter 18 of the annular member 14 is typically brazed to the metallized end surface. The flexible corrugated annular members 14 are twelve mil thick "Monel" metal members. The annular members 14 have a plurality of annular corrugations 16 formed therein to provide the requisite axial flexibility and transverse rigidity to the annular member 14. The inner perimeter 20 of the annular member 14 is brazed to the cylindrical contact support posts 22 which are alligned along a central longitudinal axis. The centrally disposed ceramic body ring 12, flexible annular members 14, and the support posts 22 comprise a hermetically sealed envelope for the vacuum switch. The switch is assembled with brazed material rings disposed between the braze seal surfaces and placed in a vacuum furnace. The switch is evacuated and the temperature is raised above the braze melting point and lowered to effect the hermetic seal.

Contact members 24 are provided at the inwardly terminating ends of the respective support posts 22 disposed within the evacuated switch. The contact members 24 are highly conductive, weld resistant disks.

Planar mounting or connector plates 26, having a support post receiving aperture therethrough are brazed to the support posts.

An electrically insulating, resilient, elastomeric annular member 28 is disposed between the opposed surfaces of the parallel planar connector plates 26. The annular member 28 is disposed about the body ring 12 and is preferably sealed to the connector plates 26 and the body ring 12. The annular member 28 is preferably a silicone resin material. The annular member is preferably preformed with a height that exceeds the spacing between the opposed parallel planar connector plates when the contacts 24 are separated. For example, the atmospheric pressure is normally enough to bring the contacts to the closed position when the switch is evacuated during fabrication. The annular member 28 is preformed of a silicone resin, such as R.T.V.-560 available from General Electric Company. The annular preform member 28 has a height of about 28 mm. Force is applied to the connector plates to move them apart to separate the contacts 24 to the open switch position, the spacing between the connector plates is 26 mm when the contacts 24 are open. The connector plates can be further separated with additional force to permit the annular member 28 to be inserted in place. The member 28 is preferably sealed in place by applying additional uncured R.T.V.-560 silicone resin as a sealing agent between the member 28 and opposed facing surfaces of the connector plates 26, as well as the body ring 12, and the perimeter of the corrugated annular member 14. The resilient annular member 28 is thus sealed in place when the silicone resin cures. The opening force is then removed and the connector plates 26 bear on the resilient annular member 28 compressing it to a height of 26 mm. which still ensures that the contacts 24 are separated and the switch is in a fail-safe open position. Positive closing force applied via the connector plates is required to close the switch by further compressing the resilient annular member 28, and the force must continue to be applied to keep the switch closed. Thus, if an air cylinder is used to apply the closing force and it should fail, the switch would open due to the spring action of the compressed resilient annular member.

The fact that the resilient annular member is sealed between the connector plates about the corrugated flexible diaphram like members prevents their exposure to the corrosive environment that is normally present in the vicinity of the chemical cells where the switch is disposed. The seal areas at the inner and outer perimeter of the corrugated flexible member would be vulnerable areas in the absence of the nonreactive, substantially impervious silicone resin sealed resilient annular member. The sealed nature also serves to keep the resilient annular member in place between the connector plates to perform its fail-safe open switch function.

What is claimed is:

1. A low voltage vacuum shorting switch which is biased to be a normally open fail-safe position switch comprising:

(a) an insulative body ring;

(b) a pair of thin flexible annular members, the outer perimeter of each annular member is sealed to opposed ends of the insulative body ring, which flexible annular members are disposed generally in a direction normal to the longitudinal axis of the body ring, and wherein the annular member has a plurality of annular corrugations formed therein;

(c) a pair of cylindrical conductive support posts aligned along the insulative ring longitudinal axis, which posts pass through and are circumferentially sealed to the inner perimeter of the respective annular member through which the post passes;

(d) planar contacts disposed at each inwardly extending end of the support posts, which contacts are spaced apart within the evacuated switch when the switch is open, which contacts are brought into contact by axial relative movement of the support posts;

(e) plate-like external connection member disposed at and electrically contacting the external terminal ends of the support posts, which plate-like external connection member extends in parallel relationship to each other in a direction normal to the support post longitudinal axis and extending in such normal direction beyond the perimeter of the flexible annular member; and (f) an electrically insulating, resilient, elastomeric annular member disposed between the opposed spaced apart parallel disposed connection members about the body ring, with the thickness and the resilience of the elastomeric annular member such that the switch contacts are normally spaced apart in an open circuit position.

2. The shorting switch specified in claim 1, wherein the elastomeric annular member is sealingly attached to the connection members.

3. The shorting switch specified in claim 2, wherein the elastomeric annular member engages the insulative body ring and the perimeter portion of the annular corrugated flexible members.

4. The shorting switch specified in claim 1, wherein the elastomeric annular member is formed of silicone resin.

5. The shorting switch specified in claim 4, wherein the elastomeric annular member is a preformed piece which is sealed in place while the support posts are urged apart to space apart the contacts in the open position.

* * * * *